US008505515B2

(12) United States Patent
Yudanov et al.

(10) Patent No.: US 8,505,515 B2
(45) Date of Patent: Aug. 13, 2013

(54) HYDRAULIC CONNECTION OF INJECTOR TO A PRESSURE SOURCE

(75) Inventors: Sergi Yudanov, V. Frölunda (SE); Lars Tenglund, Svanesund (SE)

(73) Assignee: Volvo Lastvagnar AB, Göteborg (SE)

( * ) Notice: Subject to any disclaimer, the term of this patent is extended or adjusted under 35 U.S.C. 154(b) by 870 days.

(21) Appl. No.: 12/665,339

(22) PCT Filed: Jun. 21, 2007

(86) PCT No.: PCT/SE2007/000609

§ 371 (c)(1),
(2), (4) Date: Dec. 18, 2009

(87) PCT Pub. No.: WO2008/156387

PCT Pub. Date: Dec. 24, 2008

(65) Prior Publication Data

US 2010/0126470 A1 May 27, 2010

(51) Int. Cl.
*F02M 61/14* (2006.01)

(52) U.S. Cl.
USPC ..... 123/469

(58) Field of Classification Search
USPC ..... 123/195 C, 198 D, 468, 469, 470
See application file for complete search history.

(56) References Cited

U.S. PATENT DOCUMENTS

| | | | | |
|---|---|---|---|---|
| 3,431,895 | A * | 3/1969 | Bailey | 123/470 |
| 3,845,748 | A * | 11/1974 | Eisenberg | 123/468 |
| 4,384,557 | A * | 5/1983 | Johnson | 123/198 D |
| 5,261,705 | A * | 11/1993 | Takahashi et al. | 285/197 |
| 5,499,612 | A | 3/1996 | Haughney et al. | |

FOREIGN PATENT DOCUMENTS

| | | | |
|---|---|---|---|
| EP | 0508188 | A2 | 10/1992 |
| JP | 58210359 | A | 12/1962 |
| JP | 8144886 | A | 6/1996 |

OTHER PUBLICATIONS

European Search Report for corresponding European App. EP 07 74 8271.
International Search Report for corresponding International Application PCT/SE2007/000609.

* cited by examiner

*Primary Examiner* — Stephen K Cronin
*Assistant Examiner* — Sizo Vilakazi
(74) *Attorney, Agent, or Firm* — WRB-IP LLP

(57) ABSTRACT

An internal combustion engine with a fuel injection system is provided. The injection system includes a source of pressurized fuel positioned outside an oil-wetted space of an engine and a fuel injector positioned within the space. An engine component that is a part of an engine system other than the fuel injection system is attached to the engine outside the oil-wetted space by a fastener. The fastener is provided with an internal passage forming part of a hydraulic communication between the source of pressurized fuel and the injector.

14 Claims, 2 Drawing Sheets

HYDRAULIC CONNECTION OF INJECTOR TO A PRESSURE SOURCE

BACKGROUND AND SUMMARY

The present invention relates to fuel injection systems for internal combustion engines, in particular, ways of mounting such systems in internal combustion engines.

The modern internal combustion engine is a relatively complex system consisting of many parts. Ever increasing demands for its reliability, smaller overall size, cost reduction on one hand and, on the other hand, the need of performance and emissions improvement, require innovative solutions in order to better meet these, often conflicting, requirements.

The fuel injection system is one of the most sophisticated and expensive systems of the engine, especially in case of diesel engines. A fuel injection system incorporates a great number of components. It also makes a major contribution to the cost of the engine and requires considerable installation space. Some engines have unit injection fuel systems, which are relatively simple installation-wise, because high-pressure fuel pipes are not needed there as high injection pressure is generated and used for the actual injection by one and the same assembly unit. Other engines are equipped with fuel injection systems in which the high fuel pressure necessary for injection is generated remotely from the injectors by a pump, and then high-pressure fuel pipes are utilized for the supply of high-pressure fuel to the injectors.

It is often advantageous for the diesel combustion system to position each injector centrally in the combustion chamber. In order for the overall engine height to be kept to a minimum, it is customary to place injectors entirely under the rocker cover of the engine. In that case, high-pressure fuel pipes have to be brought in from outside of the rocker cover up to the injectors positioned under the cover. The excess pressure and hot oil mist existing under the cover complicate the task of providing a simple, leak-free and easy to assemble/disassemble interface between the pipes and the rocker cover.

One way of dealing with that problem is to arrange the inlet to the space under the rocker cover separately from the cover itself. In the known design solutions, a special area in the cylinder head is allotted for installation of an hydraulic adapter, which effectively provides hydraulic connections on the inside and outside of the rocker cover whilst assuring reliable and durable seal against the oil leakage to the outside of the engine. A drawback of such designs is the relatively large space in the cylinder head that is required for the installation of the adapters. A known way of minimising the space requirement is to use two separate hydraulic adapters, one on the outside and another on the inside of the cylinder head, connected by a channel that is sealed against high fuel pressure at each of the adapters. Still, a considerable space must be reserved on the outside of the cylinder head for installation of the hydraulic adapters, and extra cylinder head material has to be provided for the connecting channel for the fuel. Twice the number of hydraulic adapters in this case also leads to increased costs and complexity.

It is desirable to provide a relatively simple, cost-effective and space-saving means for connecting an injector to a pressure source in an engine.

An aspect of the present invention incorporates a source of fuel pressure positioned outside the space that contains oil-wetted parts of the engine, an injector positioned within said space of the engine, and a fuel pipe for connecting the source of fuel pressure to the injector. The engine also has a component which is positioned outside of the oil-wetted space and is attached to the engine by a screw fastener.

To make hydraulic connection between the source of fuel pressure and the injector, an external fuel pipe is connected between the source of fuel pressure and the fastener, the fastener is made hollow, and an hydraulic adapter is installed inside the oil-wetted space of the engine, said adapter being hydraulically connected to the end of the fastener opposite to its external pipe connection end by means of a drilling made in the engine material. The drilling in the engine is sealed at both the hydraulic adapter end and the fastener end, by well-known means like "O"-ring seals or metal-to-metal sealing connections. The hydraulic adapter is connected to the injector by means of an internal fuel pipe.

An aspect of invention reduces the cost of the engine because no separate hydraulic adapter is required to be installed outside of the oil-wetted space of the engine. Instead, a suitably modified existing fastener of another functional component bolted to the engine, is used for the external hydraulic connection of the fuel injection system. The invention also contributes to reducing the overall size of the engine, because no extra space is required on the outside of the engine for installation of the hydraulic adapters.

BRIEF DESCRIPTION OF THE DRAWINGS

The invention will be further described in the following, in a non-limiting way with reference to the accompanying drawings in which.

Like reference numbers are used to designate corresponding parts of the systems depicted in the drawings.

DETAILED DESCRIPTION

Figure 1:
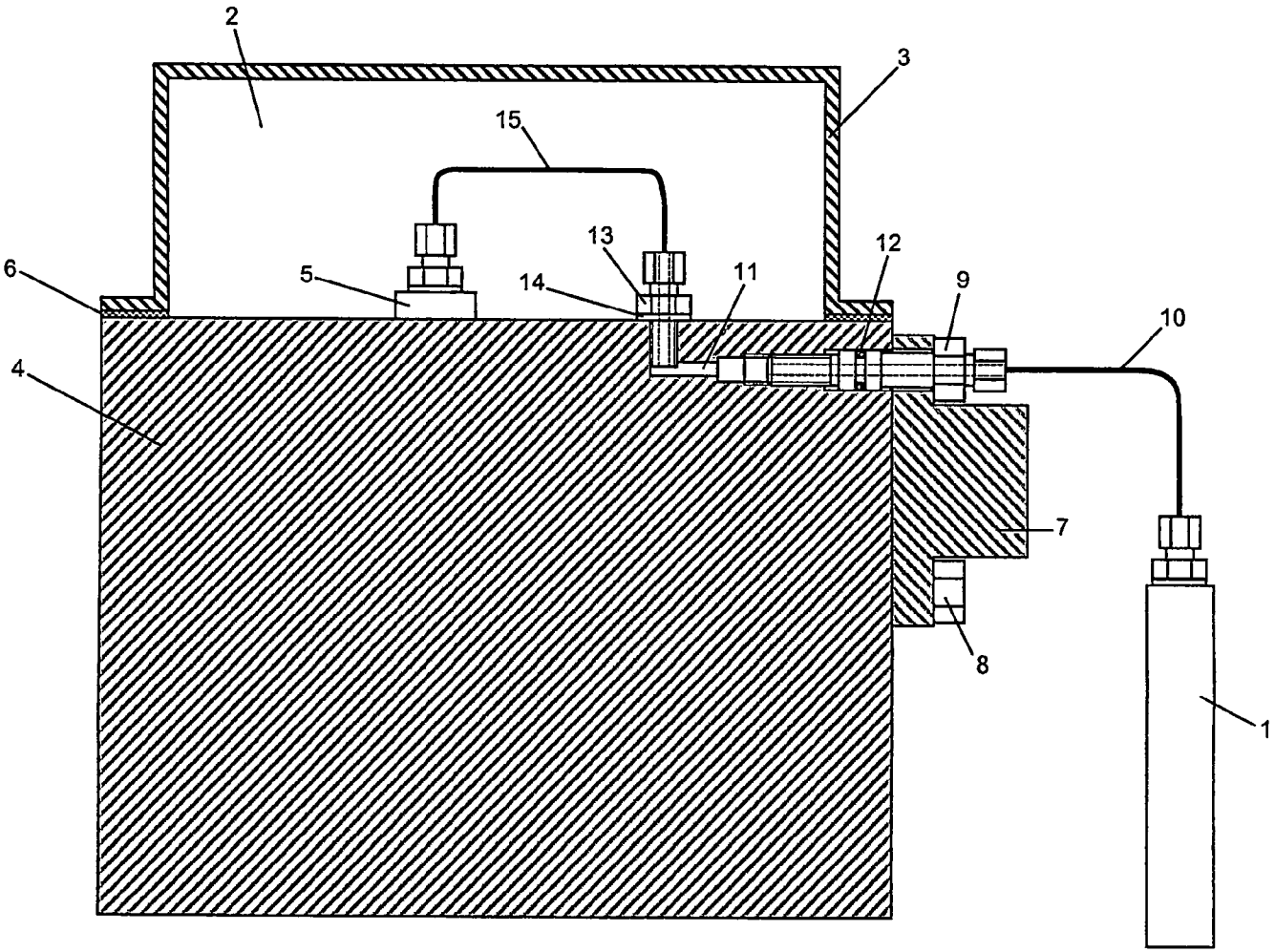
FIG. 1 is a schematic view of a preferred embodiment of the fuel injection system according to the present invention.

The invention according to the preferred embodiment contains a source of pressure 1 (FIG. 1) installed outside an oil-wetted space 2 under a rocker cover 3 of an engine 4 and an injector 5 installed within said oil-wetted space of the engine. The space 2 is sealed by a gasket 6 to prevent oil leakage to the outside of engine. The engine has a component 7 that is attached to the outside of engine with a fastener 8 and a combination fastener 9.

The combination fastener 9 is made hollow and has a suitable connection for a pipe 10 that comes from the source of pressure 1. The fastener 9 passes the flow from the source of pressure 1 and the pipe 10 into a channel 11 made in the engine 4. A seal 12 is employed between the fastener 9 and the engine 4 to prevent leakage out of the channel 11.

The other end of the channel 11 opens into the oil-wetted space 2 of the engine. At this end of the channel 11, a hydraulic adapter 13 is provided. A seal 14 is installed between the engine and the adapter 13 to prevent leakage into the space 2. An internal pipe 15 is connected between the adapter 13 and the injector 5. By these means, pressure is supplied by a source of pressure from outside the engine to the injector installed in the oil-wetted space 2 of the engine without the need to free up space on the engine for the installation of an external hydraulic connector.

Figure 2:
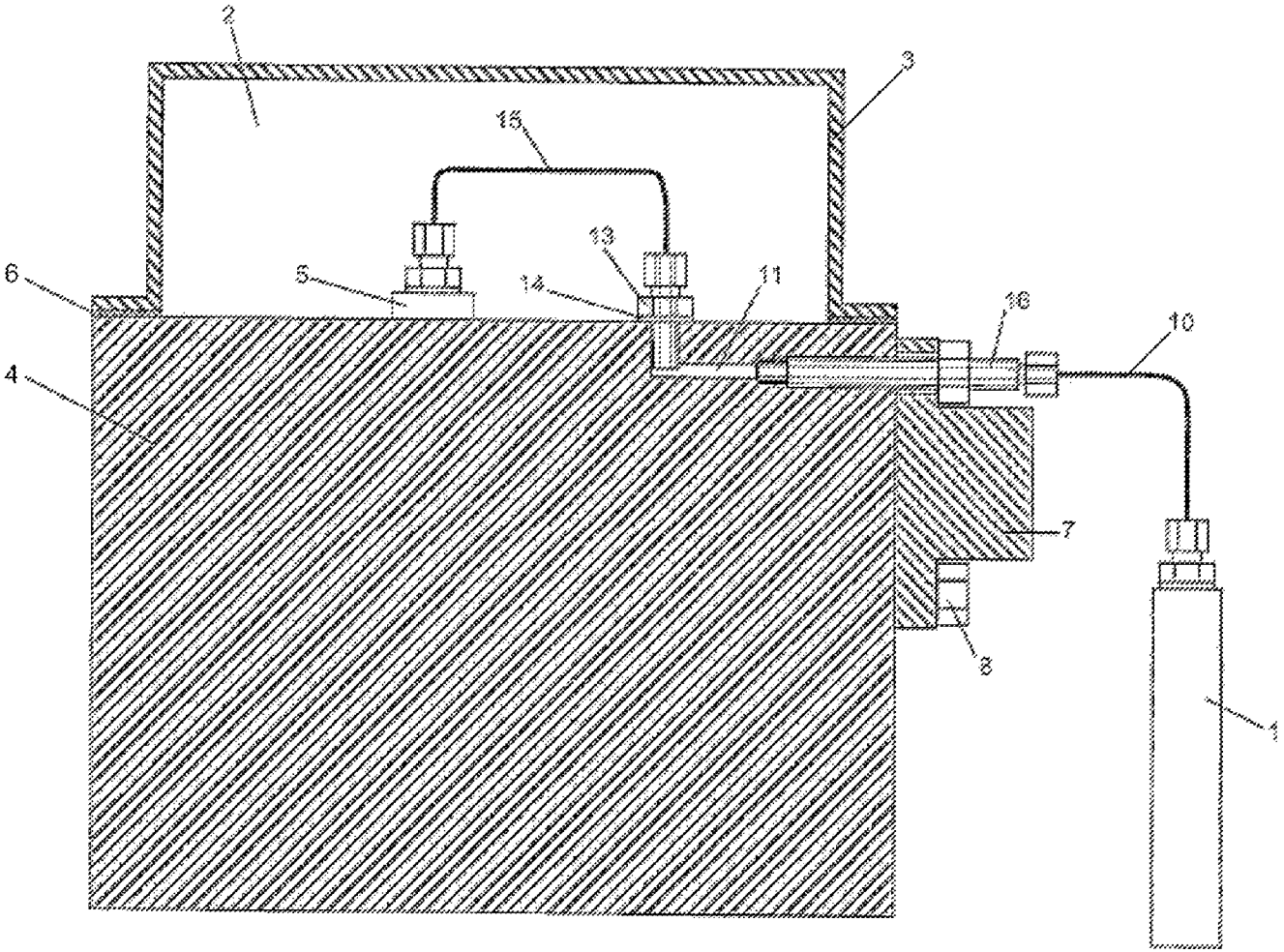
FIG. 2 is a schematic view of another embodiment of the fuel injection system according to the present invention.

In another embodiment of the invention depicted in FIG. 2, the combination fastener is made in the form of a hollow stud 16 that forms a mechanical seal with the engine 4. The function of the different components of the invention are the same, but the use of the stud can allow a reduction in the cost of the engine because no extra seal (seal 12 in FIG. 1) is required then.

Any screw or bolt fastener used for attaching components to the cylinder head may be replaced with a hollow fastener 9 and used for connecting the source of pressurized fuel to the injector. The component 7 may for example be the existing inlet manifold of the engine which is normally bolted to the cylinder head by means of conventional bolts 8.

The invention is not limited to the above-described embodiments, but several modifications are possible within the scope of the following claims.

What is claimed is:

1. An internal combustion engine with a fuel injection system comprising a source of pressurized fuel positioned outside an oil-wetted space of an engine and a fuel injector positioned within the oil-wetted space, wherein an engine component that is a part of an engine system other than the fuel injection system is attached to the engine outside the oil-wetted space by a fastener, wherein the fastener is provided with an internal passage forming part of a hydraulic communication between the source of pressurized fuel and the injector.

2. An engine according to claim 1, wherein a channel communicating with the internal passage of the fastener is provided in the engine, and the channel is sealed against leaking to both an outside of engine and to the oil-wetted space.

3. An engine according to claim 2, wherein an hydraulic adapter is installed in the oil-wetted space, the adapter is hydraulically connected with the channel and the injector, and a seal is installed between the adapter and the engine to hydraulically isolate the channel and the oil-wetted space.

4. An engine according to claim 3, wherein the fastener is made in the form of a hollow screw and a seal is installed between the fastener and the engine to prevent leakage from the channel to the outside of engine.

5. An engine according to claim 3, wherein the fastener is made in the form of a hollow stud and is sealed directly against the engine for prevention of leakage from channel to the outside of engine.

6. An engine according to claim 5, wherein the engine component is an inlet manifold.

7. An engine according to claim 1, wherein the fastener is made in the form of a hollow screw and a seal is installed between the fastener and the engine to prevent leakage from the channel to the outside of engine.

8. An engine according to claim 2, wherein the fastener is made in the form of a hollow screw and a seal is installed between the fastener and the engine to prevent leakage from the channel to the outside of engine.

9. An engine according to claim 1, wherein the fastener is made in the form of a hollow stud and is sealed directly against the engine for prevention of leakage from channel to the outside of engine.

10. An engine according to claim 2, wherein the fastener is made in the form of hollow stud and is sealed directly against the engine for prevention of leakage from channel to the outside of engine.

11. An engine according to claim 1, wherein the engine component is an inlet manifold.

12. An engine according to claim 2, wherein the engine component is an inlet manifold.

13. An engine according to claim 3, wherein the engine component is an inlet manifold.

14. An engine according to claim 4, wherein the engine component is an inlet manifold.

* * * * *